US008157264B2

(12) United States Patent
Kishon et al.

(10) Patent No.: US 8,157,264 B2
(45) **Date of Patent: *Apr. 17, 2012**

(54) GAME APPARATUS

(75) Inventors: Daniel Chaim Kishon, London (GB); Gil Druckman, Tel Aviv (IL); Edward Paap, Beverwyk (NL)

(73) Assignee: All In 1 Products Limited, Putney London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/943,689

(22) Filed: Nov. 10, 2010

(65) Prior Publication Data

US 2011/0049802 A1 Mar. 3, 2011

Related U.S. Application Data

(63) Continuation of application No. 12/159,537, filed as application No. PCT/GB2007/000232 on Jan. 24, 2007, now Pat. No. 7,837,197.

(30) Foreign Application Priority Data

Jan. 24, 2006 (GB) ..... 0601390.8

(51) Int. Cl.
*A63F 7/00* (2006.01)

(52) U.S. Cl. ..... 273/119 R; 273/118 R; 273/127 R

(58) Field of Classification Search ..... 273/108, 273/118 R, 119 R, 121 R, 127 R, 129 R, 273/129 V, 129 W
See application file for complete search history.

(56) References Cited

U.S. PATENT DOCUMENTS

| | | | | |
|---|---|---|---|---|
| 1,942,476 | A | 1/1934 | Harris | |
| 2,710,755 | A | 6/1955 | Craig | |
| 3,480,277 | A | 11/1969 | Fraser | |
| 4,046,380 | A | 9/1977 | Goldfarb et al. | 273/119 R |
| 4,052,068 | A | 10/1977 | Piacentino | |
| 4,146,227 | A | 3/1979 | Kuna | |
| 4,148,484 | A | 4/1979 | Georgiev et al. | |
| 4,286,785 | A | 9/1981 | Todokoro | |
| 4,666,160 | A | 5/1987 | Hamilton | |

(Continued)

FOREIGN PATENT DOCUMENTS

DE 1092822 B 11/1960

(Continued)

OTHER PUBLICATIONS

UK Patent Office, Combined Search and Examination Report, UK Patent Office, Apr. 21, 2006.

(Continued)

*Primary Examiner* — Raleigh W. Chiu
(74) *Attorney, Agent, or Firm* — GableGotwals

(57) ABSTRACT

An apparatus for playing a game comprising a playing surface having a first area and a second area, a projectile, and at least two propulsion devices. First and second sets of playing pieces are provided, each playing piece having a lower peg portion, and a substrate overlaying and spaced above the playing surface and extending across both the first and second areas of the playing surface. In a game, the playing pieces are located on the substrate above the first area of the playing surface, with their peg portions extending below the substrate, and each propulsion device is capable of propelling the projectile such that the projectile can impact with a peg portion of a playing piece and thereby dislodge the playing piece.

21 Claims, 5 Drawing Sheets

U.S. PATENT DOCUMENTS

| | | | | |
|---|---|---|---|---|
| 4,790,535 | A | 12/1988 | Droske, Jr. | |
| 4,867,454 | A | 9/1989 | Horvath et al. | |
| 5,785,313 | A | 7/1998 | Shiraishi | |
| 5,884,911 | A | 3/1999 | Guridi | |
| 6,585,585 | B1 | 7/2003 | Fletcher | |
| 7,837,197 | B2 * | 11/2010 | Kishon et al. | 273/119 R |
| 2009/0230620 | A1 | 9/2009 | Kishon et al. | |

FOREIGN PATENT DOCUMENTS

| | | | |
|---|---|---|---|
| GB | 1498580 | | 1/1978 |
| GB | 1498580 | A | 1/1978 |
| JP | S46-033384 | | 11/1971 |
| JP | U-49-109692 | | 9/1974 |
| JP | A-2003-162444 | | 12/2004 |
| WO | WO 88/02646 | A | 4/1988 |

OTHER PUBLICATIONS

PCT Patent Office, "International Preliminary Report on Patentability," PCT Patent Office, (Apr. 3, 2008).

PCT Patent Office, "Transmittal of International Preliminary Report on Patentability," PCT Patent Office, (Jun. 9, 2008).

Web Sudoku, "Website page from www.websudoku.com," Web Sudoku, (Jun. 13, 2008).

Puzzles by Pappocom, "Website page from sudoku.com," sucoku.com.

Yanoman, "Toy Journal, Nov. 2003," Yanoman.

Bandai, "Bandai Game 2003," Bandai.

Bandia Co. Ltd., "New Product Catalog, Jun.-Sep. 2003," Bandia Co. Ltd.

* cited by examiner

GAME APPARATUS

CROSS REFERENCES TO RELATED APPLICATIONS

This is a continuation application of U.S. patent application Ser. No. 12/159,537 filed in the USPTO on 27 Jun. 2008, which is the US National Phase of PCT Application No. GB2007/00232 filed 24 Jan. 2007, which claims priority to British Patent Application No. 0601390.8 filed 24 Jan. 2006.

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING

Not Applicable

BACKGROUND OF THE INVENTION

1. Field of the Invention

The invention relates to an apparatus for playing a game. In particular, it relates to a two player game in which the players play against each other.

2. Description of Related Art

A known game apparatus is disclosed in EP 0827763. This describes a game board in which a ball is used to knock over pins in a ten pin bowling game. This game apparatus has the disadvantage that only one player can use the game apparatus at any one time. Whilst more than one player can play indirectly against each other by recording scores, two players cannot play simultaneously. This may reduce the interest of the game.

BRIEF SUMMARY OF THE INVENTION

The present invention provides a game apparatus. Thus, two players can play simultaneously, increasing the excitement and interest of the game.

BRIEF DESCRIPTION OF THE DRAWINGS

An embodiment of the present invention will now be described, by reference to the accompanying drawings, in which.

DETAILED DESCRIPTION OF THE INVENTION

Figure 1:
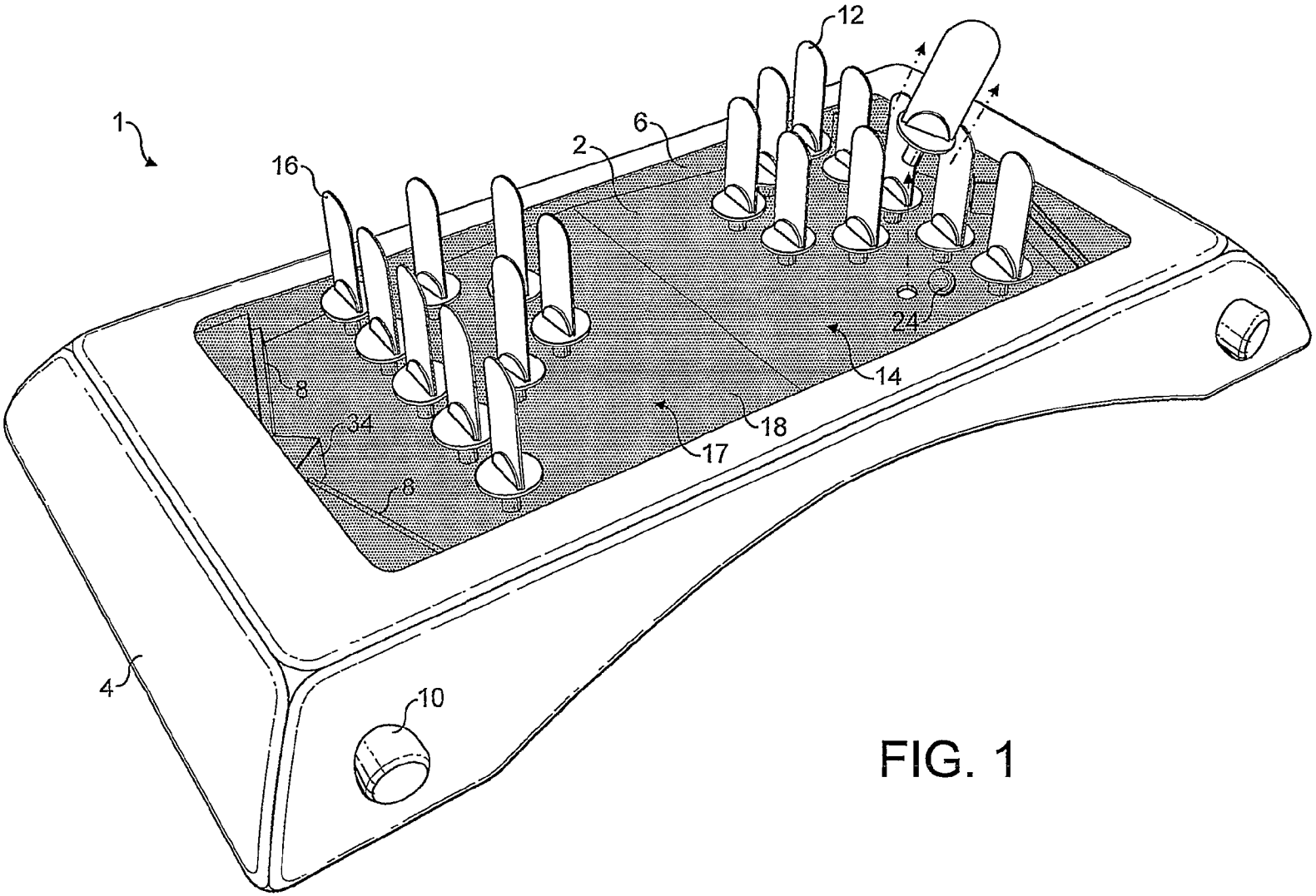
FIG. 1 is a perspective view of a first embodiment of the game apparatus of the present invention.

FIG. 1 shows game apparatus 1, which is intended for use by a first player and a second player playing a game against each other. The apparatus 1 comprises a rectangular playing surface 2 mounted in a housing 4. The housing 4 provides side walls 6 extending along the long edges of playing surface 2. Two flippers 8 are located at each of the short edges of the playing surface 2. Each flipper 8 is controlled by a button 10.

A first set of playing pieces 12 are arranged over a first area 14 of the playing surface 2. A second set of pieces 16 are arranged over a second area 17 of the playing surface 2. The playing pieces 12, 16 are supported by a transparent substrate 18 spaced above the underlying playing surface 2.

A projectile, in the form of a spherical ball 24 in play is fired across the playing surface 2 by the flippers 8. A deflector 34 is located between each pair of flippers 8. The deflector 34 is triangular in shape, in order to deflect the ball 24 onto a flipper 8.

Each flipper 8 is an arm rotatable about one end substantially in the plane of the playing surface. Actuation of each button 10 causes an associated flipper 8 to rotate. Each flipper 8 will be spring-biased by spring means (not shown) to a rest position, from which it can be rotated by depression of a button 10.

The spring means is arranged such that a small depression and release of the button 10 will result in a small retraction and rotation forwardly, and thus a small force on the ball 24.

The spring means is associated with a release means (not shown). The spring means and release means are arranged such that after a large depression of the button 10, the release means will cause the spring means to automatically release and activate the flipper 8. This provides for a large force on the ball 24. The player thus has only to apply a relatively strong force inwardly on the button 10, and at a predetermined point the flipper 8 will automatically be released to rotate and apply a force on the ball 24. The sudden release of the flipper 8 increases the initial speed of rotation of the flipper 8, allowing a greater force to be applied to the ball 24 than obtainable by merely removing pressure from the button 10 to release the flipper 8.

Each flipper 8 has a forward surface which contacts the ball 24. The forward surface has a concave profile, defining a very shallow U-shape. This arcuate shape allows the player to control the direction in which the ball 24 travels from the flipper 8, by varying the position of the ball 24 on the flipper 8 when the flipper 8 is rotated.

Figure 2:
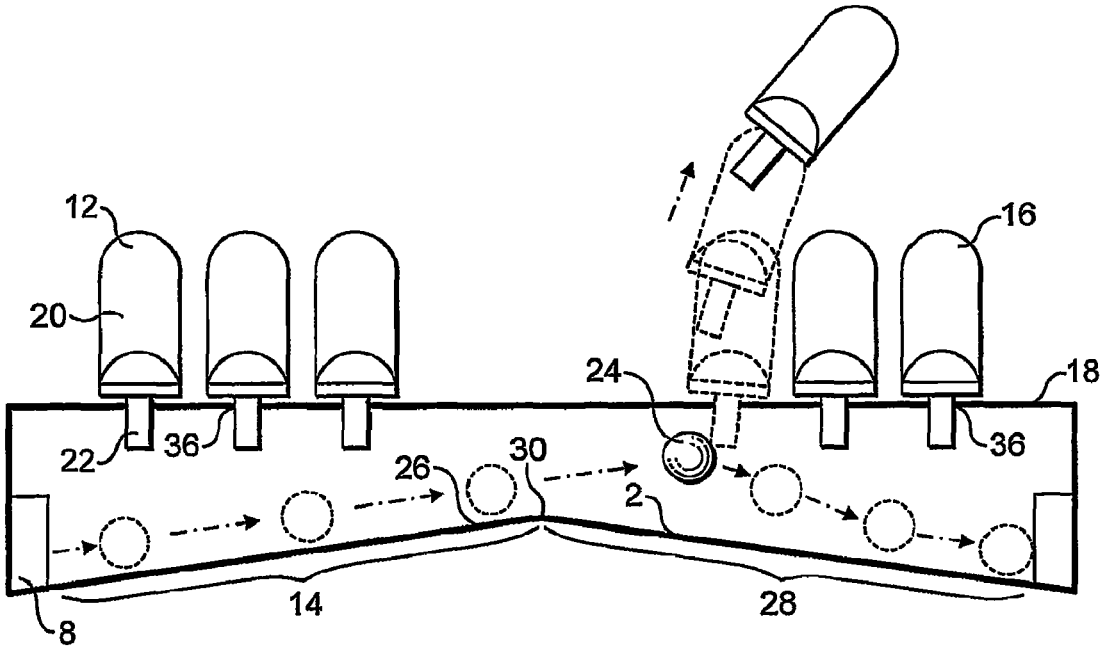
FIG. 2 is a cut away side elevation of a first embodiment of the apparatus.

With reference to FIG. 2, the substrate is a rigid laminar sheet 18. The substrate 18 is supported by the housing 4 in a horizontal plane. A plurality of circular holes 36 are formed in the substrate 18, for holding the playing pieces 12, 16 in position. The playing pieces 12, 16 each have an upper portion 20, which in use is located above the substrate 18, and a lower peg portion 22 which extends below the substrate 18. The substrate 18 supports the playing pieces 12, 16 over the playing surface 2 such that the bottoms of the lower peg portions 22 are spaced from the playing surface 2 by a distance greater than the height of the ball 24.

The playing surface 2 is shaped to affect movement of the ball 24. The first area 14 of playing surface 2 is formed by a first ramp 26 and the second area 16 by a second ramp 28. Ramps 26, 28 are inclined with respect to the horizontal, and meet at an apex 30, which is the highest point of the playing surface 2.

Figure 4:
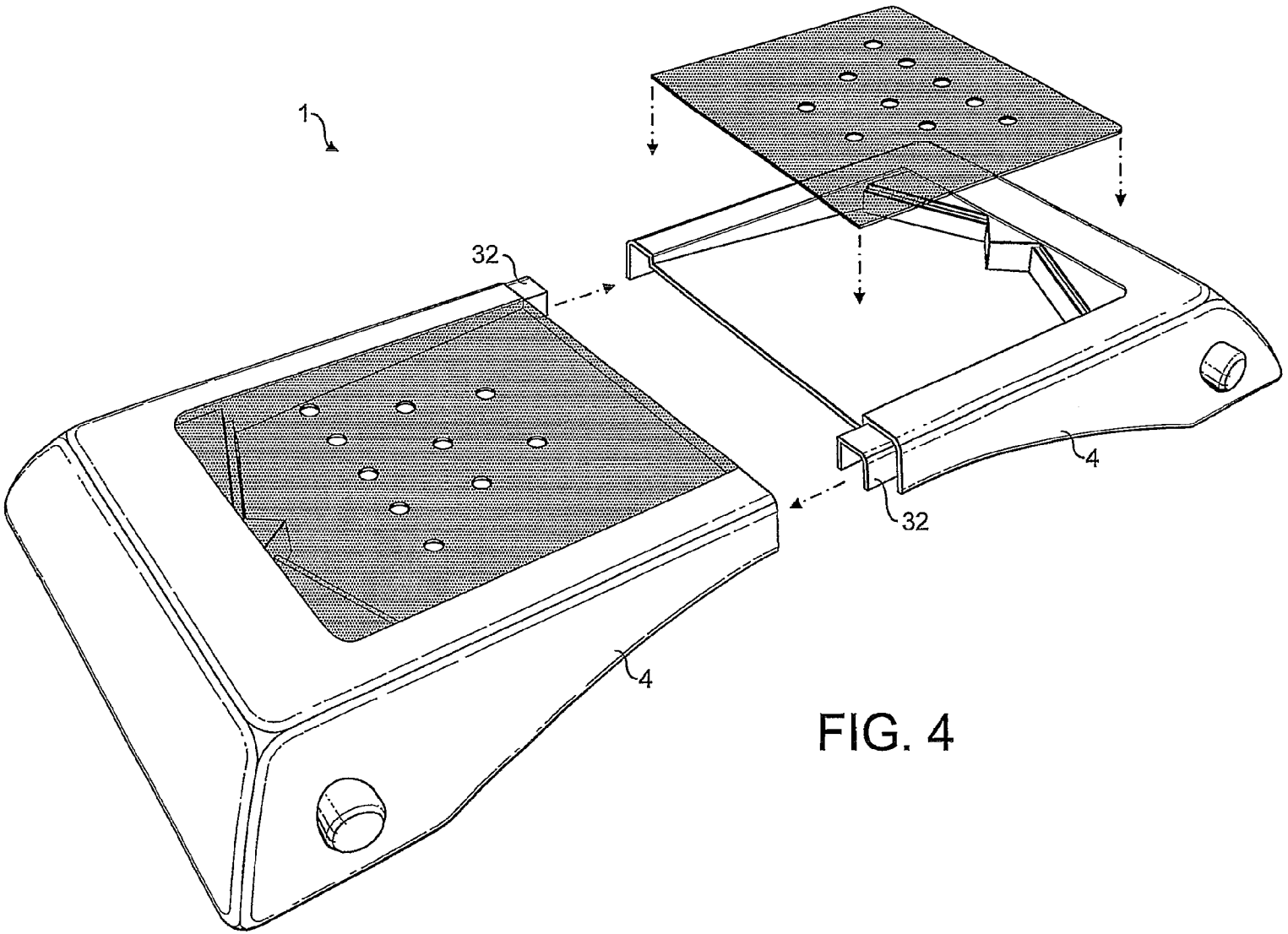
FIG. 4 is an exploded perspective view of a first embodiment of part of the apparatus of FIG. 1.

FIG. 4 shows the housing 4 is preferably formed in two pieces, and connected together by connectors 32. The substrate 18 is also formed in two pieces. This allows the apparatus 1 to be stored in a compact form.

Figure 5:
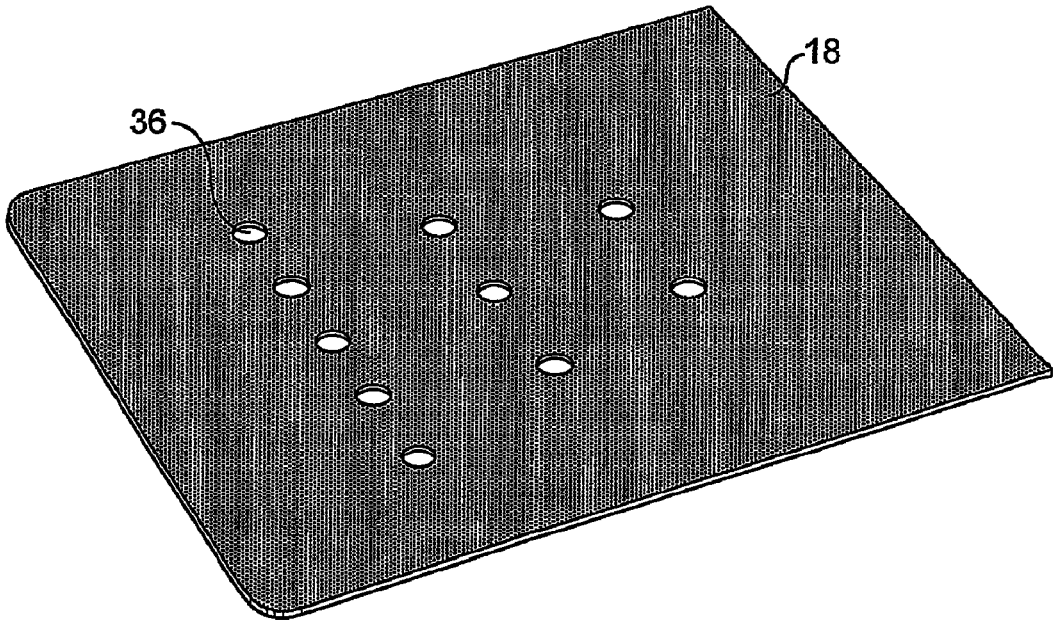
FIG. 5 is a perspective view of part of a first embodiment of the apparatus of FIG. 4.

FIG. 5 shows part of the substrate 18 in the second area 17. Holes 36 are arranged in four rows, each row being parallel to a short side of the playing surface 2.

Figure 6:
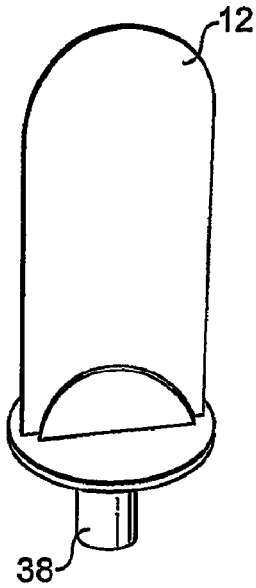
FIG. 6 is a perspective view of a part of a first embodiment of the apparatus of FIG. 1.

FIG. 6 shows a playing piece 12. The upper portion 20 is in the form of a planar, rectangular sheet with a depiction of a character. The lower portion 22 is a peg, as previously described. A circular flange 38 extends radially outwardly between the upper portion 20 and lower portion 22. The flange 38 has a diameter which is greater than the diameter of the holes 36, so that the flange 38 supports the playing piece 12 on an upper surface of the substrate 18 while the peg 22 extends through a hole 36 to below the substrate 18.

In use, the game apparatus is initially set up by placing the playing pieces 12 of the first set in the holes 36 located above the first area 14. The second set of playing pieces 16 are inserted into the holes 36 located above the second area 17. The first player locates the ball 24 on the playing surface 2 adjacent a flipper 8 at the first end 14. The first player then operates the flipper 8 by pushing the button 10. The flipper 8 rotates and propels the ball 24, at high speed along the playing surface 2 and up ramp 26. When the ball 24 passes the apex 30, the speed of the ball 24 means that it continues upwardly and so leaves the playing surface 2. If the first player is successful, the ball 24 strikes a peg 22 of a playing piece 16. The impact of the ball 24 urges the playing piece 16 upwardly out of the hole 36, causing it to lie horizontally on top of the substrate 18.

Figure 3:
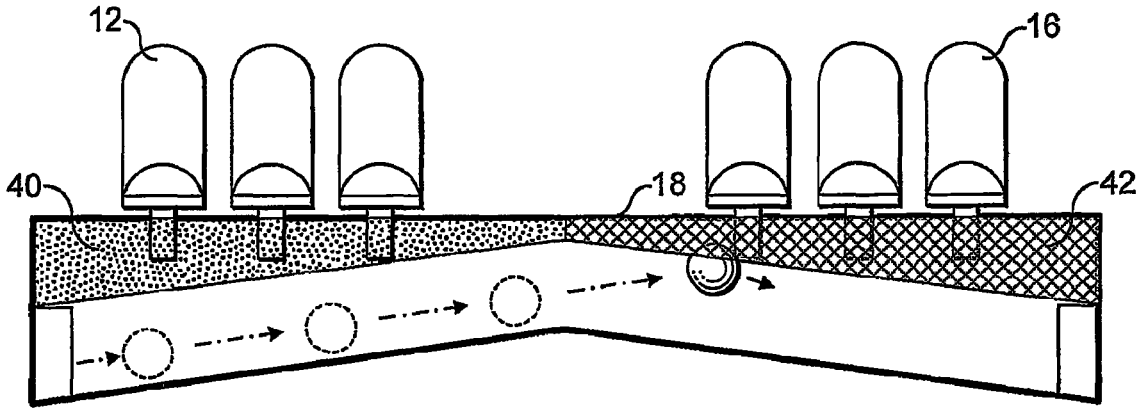
FIG. 3 is a cut away side elevation view of a first embodiment of the application.

With reference to FIG. 3, an impact area 42 is shown for the playing pieces 16 of the second player when the first player is in control of the ball 24. The pegs 22 of the playing pieces 16 of the second player in this area 42 may be hit by the ball 24 after it flies off the ramp 26. A safe area 40 for the playing pieces 12 of the first player is shown. The lower portions 22 of the playing pieces 12 in this area 42 will not be hit by the ball 24, since the ball 24 will safely pass underneath them. The ramps 26, 28 therefore provide a means for the ball to strike the playing pieces of the opponent player, and not strike the playing pieces of the player who is controlling the ball. The danger area 40 and safe area 42 clearly reverse sides when the second player has a turn.

If the first player is unsuccessful, the ball 24 will return to the playing surface 2 without knocking a playing piece 16 from its hole.

Whether successful or unsuccessful, the ball 24 will then roll to adjacent a flipper 8 at the second side 17, controlled by the second player. The second player can then actuate the flipper 8 by pushing the associated button 10, and attempt to knock out a playing piece 12 of the first player in the same manner as described above.

The winner of the game is the first player to knock all of his or her opponent's playing pieces out of their holes.

Figure 7:
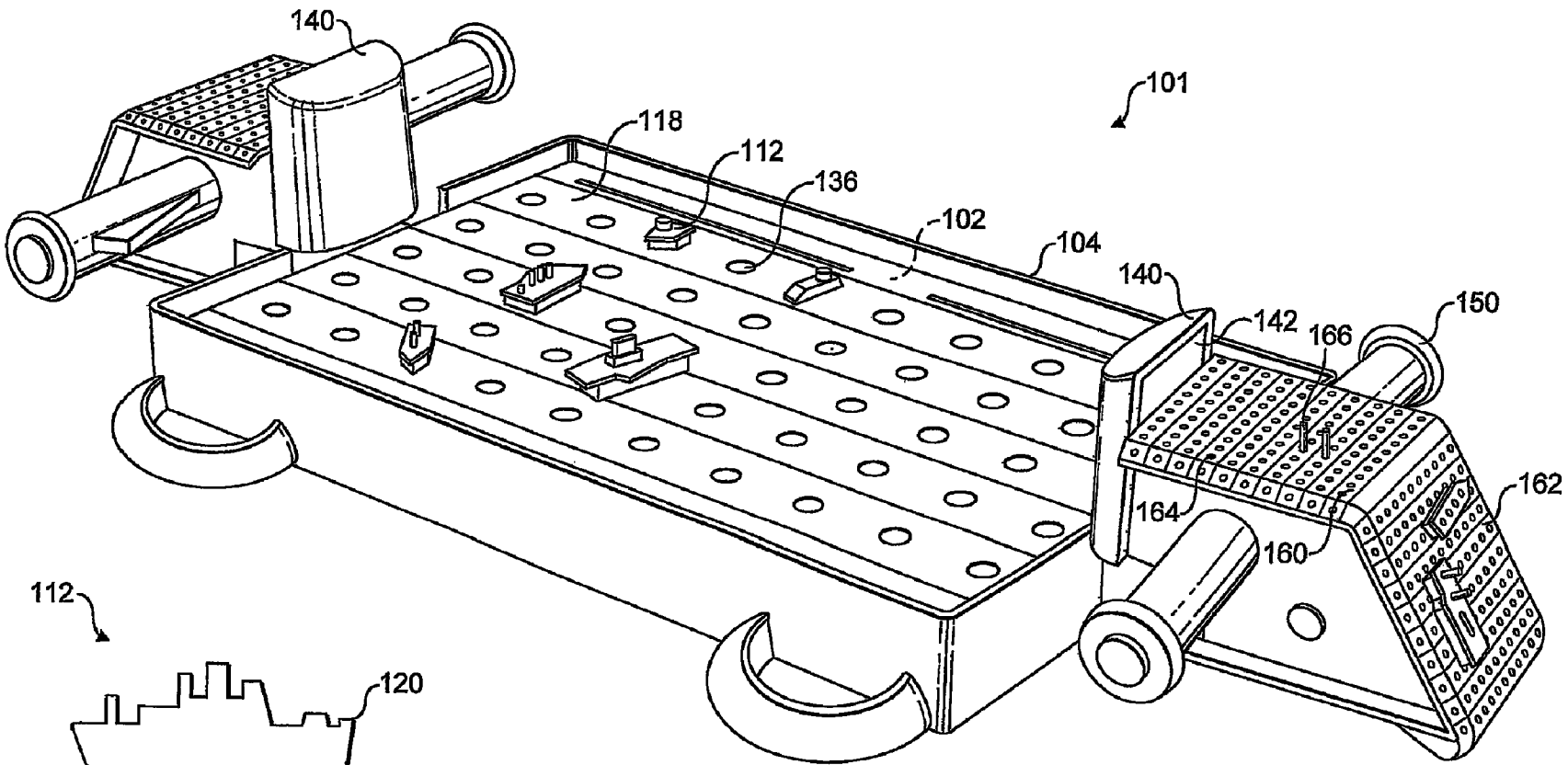
FIG. 7 is a perspective view of a second embodiment of the present invention.

A second embodiment of the present invention is shown in FIG. 7. The apparatus 101 is intended for use by a first player and a second player playing a game against each other. The apparatus 101 can be used to play a "Battleships" type game, in which the players attempt to find their opponent's ships by guessing squares. The apparatus 101 allows conventional game play, and additionally provides apparatus to "destroy" an opponent's ships.

The apparatus 101 comprises a rectangular playing surface 102 mounted in a housing 104. The housing 104 provides side walls 106 extending along the long edges of playing surface 102.

A first set of playing pieces 112 are arranged over a first area of the playing surface 102. Alternatively, a second set of pieces (not shown) are arranged over a second area of the playing surface 102. The playing pieces 112 are supported by a substantially opaque substrate 118 spaced above the underlying playing surface 102.

The substrate is a rigid laminar sheet 118. The substrate 118 is supported by the housing 104 in a horizontal plane. A plurality of circular holes 136 are formed in the substrate 118, for holding the playing pieces 112, 116 in position. Holes 136 are arranged in a grid.

A projectile, in the form of a spherical ball (not shown) in play is fired across the playing surface 102 by a ball firing means (not shown).

The playing surface 102 is shaped to affect movement of the ball. The first area of playing surface 102 is formed by a ramp (not shown) and the second area 116 by a second ramp (not shown). Ramps are inclined with respect to the horizontal, to define a trough, the meeting line between the ramps being the lowest point of the playing surface 102.

The apparatus 101 comprises two viewing devices 140, one located at each of the short edges of the playing surface 102. The viewing device 140 resembles an upside-down periscope. The viewing device 140 has a viewing aperture or screen 142 above the level of the substrate 118, configured to allow a player to look into the viewing device. The viewing device 140 has a target aperture or screen (not shown) located between the level of the substrate 118 and the playing surface. The viewing device 140 comprises mirrors and/or prisms (not shown) providing an optical path between the viewing aperture and the target aperture.

The viewing device 140 is rotatable about a vertical axis, such that a player can rotate the viewing device by gripping handles 150. The viewing device 140 is arranged such that a player looking into the higher part of the device 140, at the viewing aperture, is able to see beneath the substrate 118.

A ball firing means is attached to each of the viewing devices 140. Each ball firing means is adapted to receive a ball, and eject the ball in a direction chosen by a player. The operation of each ball firing means is controlled by a button. The ball firing means is rotatable about a vertical axis as the viewing device 140 is rotated.

The viewing device 140 is provided with sights (not shown). The sights provide a visual indication of the direction of travel of a ball fired by the ball firing means.

The apparatus 1 comprises two pairs of marker boards 160, 162. The boards 160, 162 are provided with a grid having plurality of blind bores 164. Each board 160, 162 has rows labeled 1 to 10, and columns labeled A to J.

A marker 166 can be placed in a bore 164 in order to assist with game play. Markers are provided in two colors, one color, for example red, to mark a "hit" and one color, for example white, to mark a "miss".

Figure 8:
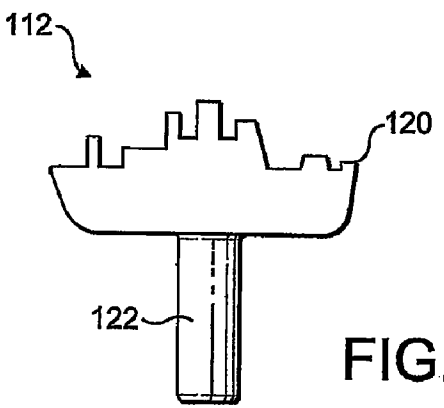
FIG. 8 is a side elevation view of part of the apparatus of the second embodiment of the present invention.

FIG. 8 shows a playing piece 112. Each piece 112 has an upper portion 120 which in use is located above the substrate 118, and a lower peg portion 122 which extends below the substrate 118. The upper portion 120 is in the form of a ship. The substrate 118 supports the playing pieces 112, 116 over the playing surface 102 such that the bottoms of the lower peg portions 122 are spaced from the playing surface 2 by a distance less than the height of the ball 124. The lower portion 22 is a circular peg, as previously described, with a diameter less than the diameter of the holes 137.

The housing 104 may form part of the packaging of the apparatus 101, such that a reduced amount of additional packaging is required.

In use, the game apparatus is set up with none of the playing pieces 112, 116 on the substrate 118. The first and second players play the known game of battleships on boards 160, 162.

The first player attempts to guess the location of a ship of the second player. The first player does this by stating their guess that a ship is at a particular position, identified by the column and row identifiers. If the first player guesses successfully, the second player must declare that there has been a "hit". Since the ships preferably cover two or more bores 164, the ship as a whole is not immediately 'found'. If the first player's guess does not coincide with a ship, the second player declares there has been a 'miss'. The second player then guesses the location of a ship of the first player, and play repeats.

Once a player has successfully achieve a 'hit' on all of the hole positions which a single ship occupies, that ship is considered to be 'found'. The player who found the ship scores 20 points, and the opportunity to 'destroy' the ship. An equivalent ship is placed on the substrate, with its pegs extending through a hole 136. The ship is 'destroyed' by means of the viewing device 140 and ball firing means. The player looks through the viewing device 140 to view the playing surface 102. The player rotates the viewing device 140 to line up the peg 122 of the ship with the sights. Once the peg is lined up with the sights, the player fires a ball from the ball firing means towards the peg. If the ball successfully strikes the peg, the peg will be forced upwardly and cause the playing pieces to be urged out of the hole. The playing piece 112 will then lie entirely above the substrate 118, and the ship considered to be 'destroyed'. The player will receive 20 points for destroying the ship.

If the player was not successful with their first shot, the player may take another shot. The player may be allowed up to five shots to destroy the ship. If none of the shots are successful, then the player is awarded no points and the play continues.

Once all of the ships have been wholly located, all of a set of pieces 112, 116 may be placed on the substrate 118 and the player provided with five balls to dislodge as many pieces as possible from the substrate 118. The winner of the game is the player with the most number of points once all the ships have been identified.

The substrate 118 has been described as opaque. Alternately, the substrate 118 may be transparent, or may be semi-opaque. In particular, the substrate 118 may be 'frosted' to allow a player to have a distorted or incomplete view of the surface below the substrate.

The invention claimed is:

1. Apparatus for playing a game, said apparatus comprising:

a playing surface having a first area and a second area;

a projectile;

at least two propulsion devices, one propulsion device located at a first end of the playing surface adjacent the first area of the playing surface and a second propulsion device located at a second end of the playing surface adjacent the second area of the playing surface, each propulsion device being operable to propel the projectile across the playing surface towards the other propulsion device;

first and second sets of playing pieces, each playing piece having a lower peg portion;

a substrate overlaying and spaced above the playing surface and extending across both the first and second areas of the playing surface, the substrate having apertures through which the peg portions of the playing pieces can project below the substrate when the playing pieces are located on the substrate;

in a game, the playing pieces are located on the substrate above the playing surface, with their peg portions extending below the substrate;

each propulsion device is capable of propelling the projectile such that the projectile can impact with a peg portion of a playing piece and thereby dislodge the playing piece to a dislodged position in which the playing piece lies entirely above the substrate, the substrate supporting the playing piece in the dislodged position and preventing the projectile from making further contact with the dislodged playing piece; and ramps which provide a means for the projectile to strike the playing pieces of the first set and not strike the playing pieces the second set when propelled by the second propulsion device and for the projectile to strike the playing pieces of the second set and not strike the playing pieces of the first set when propelled by the first propulsion device.

2. The apparatus according to claim 1 wherein:

said first area is ramped with a height which inclines upwardly away from said first end of said playing surface and said second area is ramped with a height which inclines upwardly away from said second end of said playing surface, the ramped areas meeting at a common apex located between said first and second ends;

on beginning a game, the playing pieces of said first set are located on said substrate above said first area of said playing surface, with said peg portions extending below said substrate;

on beginning a game, said playing pieces of said second set are located on said substrate above said second area of said playing surface, with said peg portions extending below said substrate;

said substrate is spaced apart from said playing surface by a distance sufficient that said projectile when propelled by said first propulsion device passes across said first area of said playing surface without impacting peg portions of said first set of playing pieces and likewise that said projectile when propelled by said second propulsion device passes across said second area of the playing surface without impacting peg portions of said second set of playing pieces; and each propulsion device is capable of propelling said projectile at a speed sufficient that said projectile on reaching said apex, after passing across either said first or said second area of said playing surface, lifts off from said playing surface and can impact with a peg portion of a playing piece and thereby dislodge the playing piece.

3. The apparatus according to claim 1 wherein said substrate is planar.

4. The apparatus as claimed in claim 1 wherein each playing piece has a radially extending flange, with a diameter greater than the diameter of the peg portion, each flange providing a downwardly facing support surface for engaging an upper surface of the substrate.

5. The apparatus according to claim 1 wherein first and second propulsion devices each comprise a flipper pivotable about one end thereof.

6. The apparatus of claim 5 wherein a surface of said flipper for contacting said projectile is arcuate.

7. The apparatus of claim 5 wherein:

said first propulsion device is one of a first pair of flippers provided at said first end of said playing surface, said flippers of the first pair extending inwardly towards each other from spaced apart pivot points; and said second propulsion device is one of a second pair of flippers provided at said second end of said playing surface, said flippers of the second pair extending inwardly towards each other from spaced apart pivot points.

8. The apparatus of claim 7 wherein said flippers of each pair are separated by a deflector which when impacted by said projectile deflects said projectile on to one of said flippers.

9. The apparatus of claim 5 wherein each flipper is biased to a rest position by a spring means for activating said flipper.

10. The apparatus of claim 9 wherein each flipper is provided with an associated manually operable control.

11. The apparatus of claim 9 further comprising a release means for releasing said spring means associated with the spring means and the manually operable control, the release means arranged such that operation of the control effects storage of energy in the spring means, and further operation of the control automatically effects release of energy in the spring means to activate said flipper.

12. The apparatus of claim 1 wherein said playing surface is formed in two parts, releasably connectable together.

13. The apparatus of claim 1 wherein the first area of said playing surface is ramped with a height which inclines downwardly away from the first end of the playing surface and the second area of said playing surface is ramped with a height which inclines downwardly away from the second end of the playing surface, the ramped areas meeting at a common low point located between the first and second ends.

14. The apparatus according to claim 13 wherein the substrate is planar and substantially opaque.

15. The apparatus according to claim 13 further comprising a viewing device, the viewing device having a viewing screen or aperture capable of showing a target view of the apparatus between the substrate and the playing surface.

16. The apparatus according to claim 15 wherein said viewing device comprises mirrors and/or prisms to provide a line of sight between said viewing aperture and said target view.

17. The apparatus according to claim 15 wherein said viewing device is rotatable about a vertical axis such that said target view can be scanned horizontally.

18. The apparatus according to claim 15 wherein a propulsion device is attached to said viewing device.

19. The apparatus according to claim 18 wherein said viewing device comprises sights, the sights indicating the expected path of a projectile released from said propulsion device.

20. The apparatus according to claim 13 wherein the substrate is planar.

21. The apparatus according to claim 13 wherein each playing piece is in the shape of a ship having a length greater than a diameter of the peg portion.

* * * * *